US005880916A

United States Patent [19]

Hsieh

[11] Patent Number: 5,880,916

[45] Date of Patent: Mar. 9, 1999

[54] REFINE ON THE GENERATE CORONA DISCHARGES

[75] Inventor: Ting-Shin Hsieh, Taipei, Taiwan

[73] Assignee: Xetin Co., Inc., Taipei, Taiwan

[21] Appl. No.: 15,357

[22] Filed: Jan. 29, 1998

[51] Int. Cl.[6] ..... H01T 23/00

[52] U.S. Cl. ..... 361/230; 361/232

[58] Field of Search ..... 361/212, 213, 361/216, 217, 230, 231, 232; 422/186.07, 186.04; 250/324–326; 96/63.95, 97

[56] References Cited

U.S. PATENT DOCUMENTS

| | | | |
|---|---|---|---|
| 3,611,414 | 10/1971 | Frank | 347/123 |
| 4,109,289 | 8/1978 | Kuge et al. | 361/230 |
| 4,227,894 | 10/1980 | Proynoff | 96/58 |
| 4,743,275 | 5/1988 | Flanagan | 95/28 |
| 5,451,754 | 9/1995 | Reale | 250/324 |
| 5,733,512 | 3/1998 | Tsai et al.. | 422/186.15 |

*Primary Examiner*—Richard T. Elms
*Assistant Examiner*—Kim Huynh
*Attorney, Agent, or Firm*—Pro-Techtor International Services

[57] ABSTRACT

A refine on the generate corona discharges which contains one base; one low-voltage plate that is set in the base; one insulating board that covers the low-voltage plate; one high-voltage plate; and one cover board that fixes the high-voltage plate in position. The high-voltage plate is suspended and is as close as possible to the insulating plate, thereby greatly reducing the noise that accompanies the occurrence of coronas; also, said high-voltage plate is in a paper-clip shape that facilitates the production of ozone [$O_3$] from the oxygen molecules [$O_2$] contained in the air that passes through the corona area.

2 Claims, 3 Drawing Sheets

REFINE ON THE GENERATE CORONA DISCHARGES

BACKGROUND OF THE INVENTION

1. Field of the Invention

The present invention is a type of improvement relating to a corona generator. It especially refers to a refine on the generate corona discharges used for air-purification purposes in relatively small, sealed spaces, such as in the passenger compartment of an automobile, such that, during the occurrence of a corona, noise can be greatly reduced without reducing the concentration of ozone.

2. Description of the Prior Art

As is known from the literature published in this country and other countries on ozone technology, the most common method of generating ozone is to force air or pure oxygen ($O_2$) through the "surface" discharge area formed by high-voltage electricity opposite low voltage electricity (also know as corona). The theoretical reaction formula for the phenomenon therefrom produced is:

$$2O_2 <=> [O]+O_3$$

$$M+O_3 <=> O_2+[O]+M$$

$$[O]+[O]+M <=> O_2+M$$

The ozone concentration therefrom produced is directly related to the size of said corona area and the oxygen content of the air that passes through said corona area. In industrial and commercial applications, ozone can be used to purify, deodorize, and sterilize air or water.

In recent years, several patents have been developed both in this country and in other countries that relate to corona generators, such as U.S. Pat. Nos. 4,109,289 and 5,502,346 and Taiwan Patent Nos. 78212629 and 83203594. However, these have not been oriented towards use in small rooms or the passenger compartments of automobiles. The cause for this lies in the fact that the corona generators that are currently used for commercial purposes or in household ozone units must leave a gap of from 1 to 2 mm for the occurrence of coronas between the high-voltage plate and the insulating board of the low-voltage plate in order to provide a flow of air through said corona area. When high voltage plates discharge electricity at the opposing low-voltage plate and a corona occurs, there is no relatively superior method to reduce the accompanying noise (see FIG. 5). If it is used in a passenger compartment with closed windows and doors or in a relatively small room, it is certain to make people feel uncomfortable. Moreover, as a result of the structure of existing corona generators, though mere adjustment of the gap between said high-voltage plate and insulating board may lower the volume of the noise during the occurrence of a corona, the volume of air flowing through said corona area is simultaneously reduced, with the result that ozone concentration drops sharply and the hoped for effect is not achieved.

SUMMARY OF THE INVENTION

The problem that the present invention is to solve: Primarily, to improve the shape and installation structure of the high-voltage plate of the corona generator and to improve the relationship between it and the insulating board at the time of assembly in order to reduce noise greatly during the occurrence of coronas without reducing the resulting ozone concentration.

The fact that in the corona generator of the present invention, said high-voltage plate has a paper-clip shape, such that, when the generator is assembled, the high-voltage plate does not obstruct the flow of air through the corona area regardless of how small the gap may be between it and the insulating board of the low-voltage plate, is a characteristic of the present invention.

The fact that in the corona generator of the present invention, said high-voltage plate is securely suspended from the cover board such that an abundant quantity of ozone [$O_3$] can be produced from the air that is forced through the corona area is another characteristic of the present invention.

The fact that in the corona generator of the present invention the gap between said high-voltage plate and the insulating board is very small, which has the effect of greatly reducing the noise that accompanies the occurrence of coronas, is another characteristic of the present invention.

DESCRIPTION OF THE PREFERRED EMBODIMENT(S)

Figure 1:
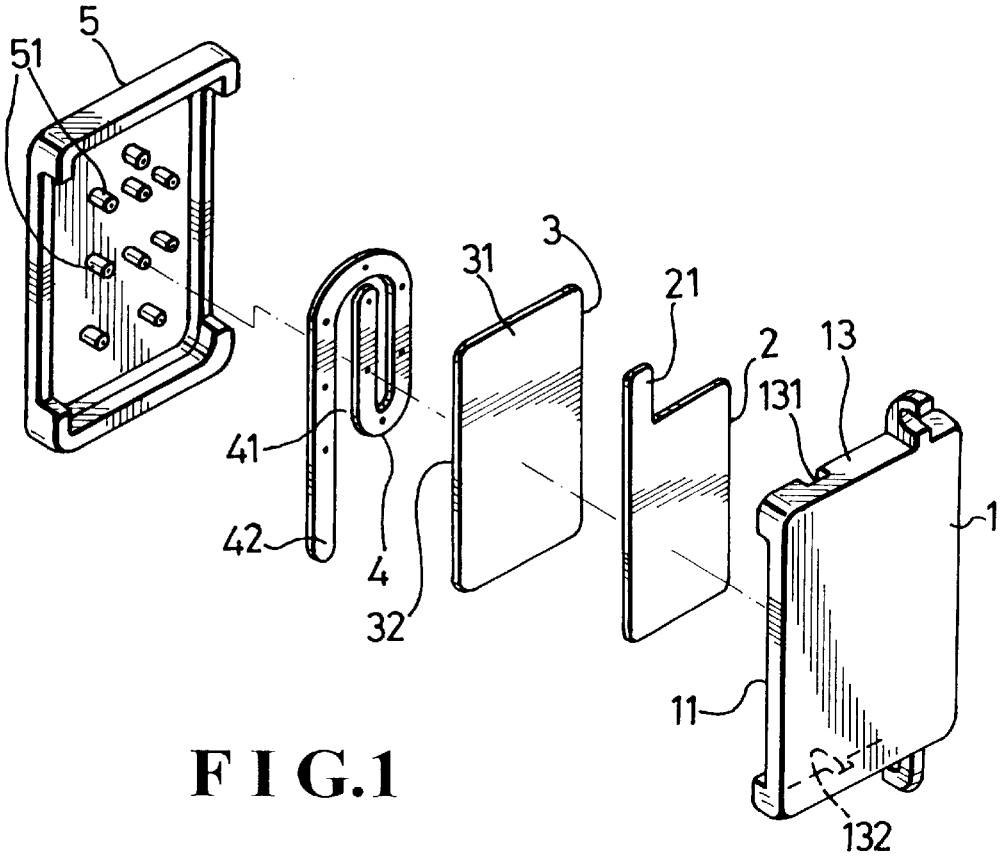
FIG. 1 is an exploded view of the present invention.
Figure 2:
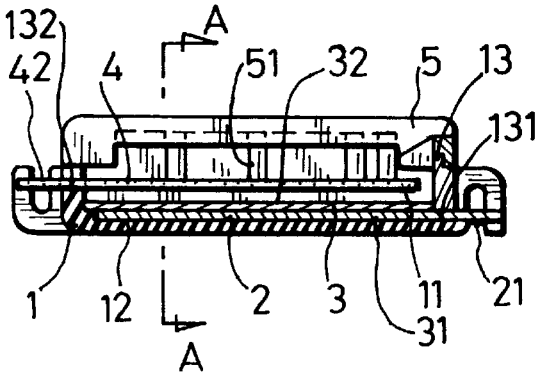
FIG. 2 is a cutaway view of FIG. 1 after assembly.

Please consult the attached figure. The corona generator of the present invention is composed of one base 1, one low-voltage plate 2 and insulating board 3 set in base 1, one high-voltage plate 4, and one cover board 5. Said base 1 is made from insulating materials. The notch 11 formed in its side wall 13 allows the passage of air or ozone. The base of the base is slightly sunken 12 towards the inside to allow the low-voltage plate 2 and the insulating board 3 to be fit into the base. The base side wall 13 provides apertures 131 and 132.

Said low-voltage plate 2 is set in the recess 12 of the base. Its terminal 21 extends through the aperture 132 and protrudes from the base 1 so as to facilitate connection with the low-voltage pole of the output side of the booster that boosts 12 V DC electricity to 8,000 to 10,000 V. (Note: The booster is not within the field of the present invention. Therefore, it is not shown in the figures.)

Said insulating board 3 is fit over the the recess 12 of the base. Its base side 31 is even with the top of the recess 12 of the base so as to facilitate the passage of air through the corona area across the top side 32 of the insulating board. The base side 31 of the insulating board should be placed flush against the low-voltage plate 2 in order to reduce electrolytic corrosion of the low-voltage plate 2. It also serves to ensure that, during the occurrence of a corona, there will be no concentrated discharge phenomena between the high-voltage plate 4 and the low-voltage plate 2. The covering area of said insulating board 3 must be larger than the low-voltage plate 2. (Note: The positions of the low-voltage plate terminal 21 and the high-voltage plate terminal 42 are staggered. Therefore, the terminals will not cause concentrated discharge phenomena to occur.)

Figure 4:
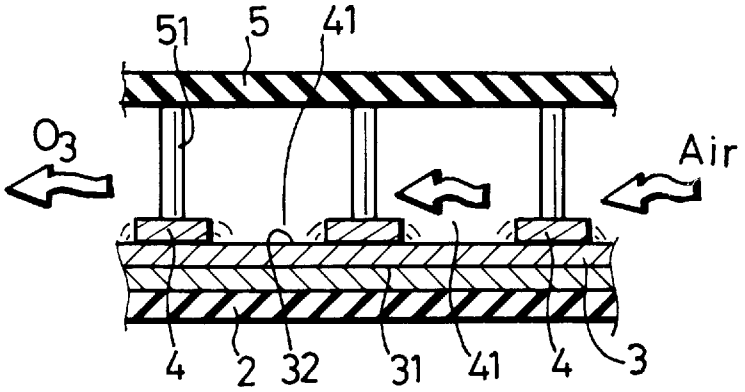
FIG. 4 is a schematic flow diagram of another preferred embodiment of air passing through the corona area. (Said high-voltage plate is placed flush against the insulating board per FIG. 2 A—A cutaway.)
Figure 3:
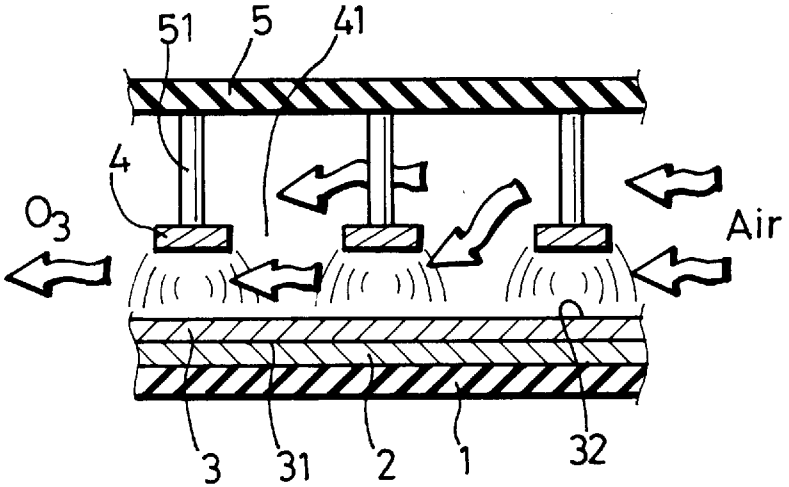
FIG. 3 is a schematic flow diagram of air passing through the corona area. (The gap between said high-voltage plate and the insulating board is $\leqq 0.5$ m/m per FIG. 2 A—A cutaway).
Figure 5:
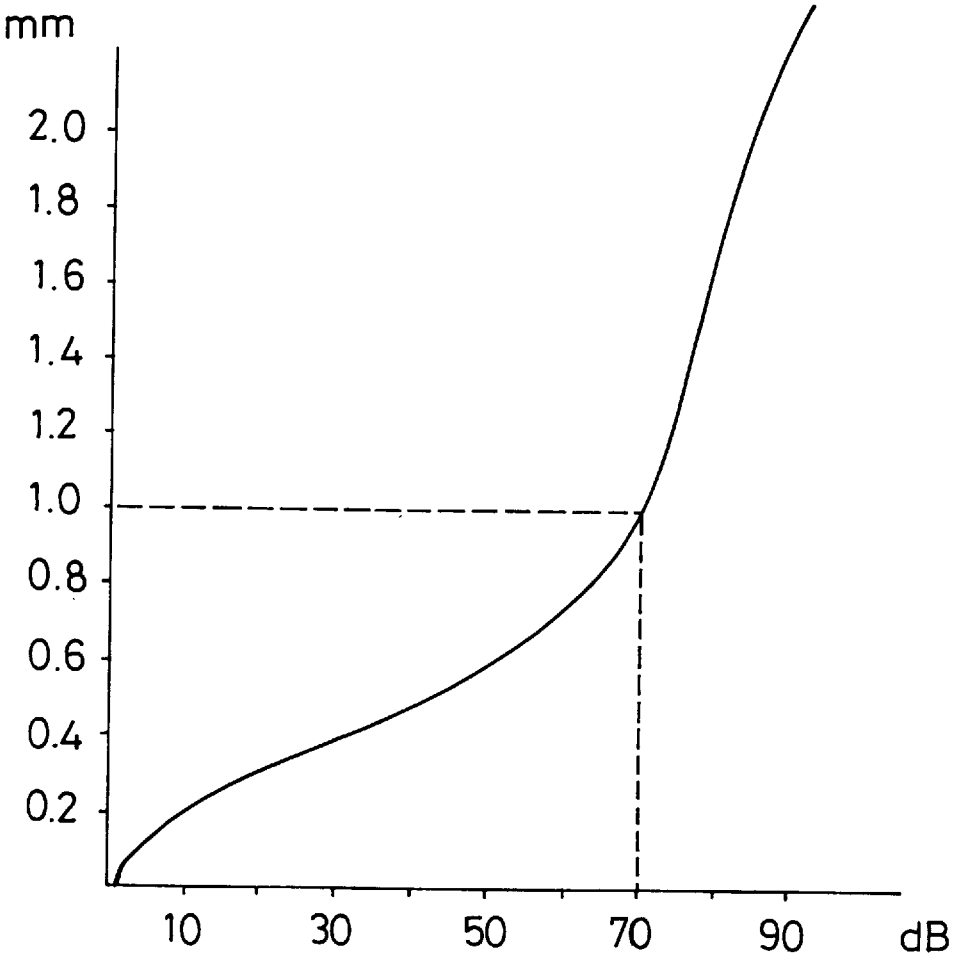
FIG.5 PRIOR ART
FIG. 5 is a graph of a noise-gap curve during the occurrence of a corona where the gap is the distance between the high-voltage plate and the insulating board.

The high-voltage plate 4 is in the shape of a paper clip. The gaps 41 within the paper clip allow air or ozone to pass through. In addition, coronas 42 may occur between the gaps and the low-voltage plate 2. Said air that passes through the corona area, besides passing through the space between the high-voltage plate 4 and the insulating board 3, flows back and forth through the paper-clip gaps 41 of the high-voltage plate 4 so that abundant quantities of ozone can be produced from the air. (See FIG. 3 and FIG. 4.) Therefore, if the number of loops of the high-voltage plate 4 is increased, the surface area for generating coronas is correspondingly increased, thereby making it possible to attain higher concentrations of ozone. Moreover, the high-voltage plate 4 is fixed in position by a projecting rib 51 on the inner side of the cover board 5 and is suspended above the insulating board 3. During installation, with adjustments being made according to need, it must maintain a very small distance (≦0.5 m/m) from the insulating board 3 or be placed flush against the insulating board 3 (see FIG. 3 and FIG. 4), thereby lowering the volume of noise that accompanies corona generation (see FIG. 5). A terminal 42 of the high-voltage plate 4 extends through another aperture 131 in the base so that it connects with the high-voltage pole of the output side of the booster that boosts 12 V direct current electricity to 8,000 to 10,000 V.

The cover board 5 is made from insulating materials. Its inner side provides multiple projecting ribs 51 so as to fix the high-voltage plate 4 in position. After the cover board 5 is placed on the base 1, it is joined by high-frequency fusion jointing or another equally effective method, causing air or ozone to pass through the corona area by means of notch 11 of the base.

To summarize the above, the present invention truly does greatly reduce noise without lowering ozone concentration. Hence, this patent application is submitted according to law.

I claim:

1. A refine on the generate corona discharges which comprising:

one base, having a notch formed by two side walls that allows passage of air or ozone; on each side wall is provided an aperture through which plate terminals are extended; the base of the base is slightly sunken towards the inside;

one low voltage plate that is set in a recess of the base and whose terminal extends through the aperture in the side wall of the base;

one insulating board that is fit over the recess in the base; its base side is even with the top of the recess in the base; the insulating board must be larger than said low-voltage board;

one high-voltage board in the shape of a paper clip that is suspended above said insulating board, with a terminal extending through another aperture in the side wall of the base; and one cover board, whose inner side is provided with projecting ribs, whereby the high-voltage board is fixed into position, causing the high-voltage board to be as close as possible to the insulating board; the cover is joined to the base.

2. A refine on the generate corona discharges as claimed in claim 1 wherein the gap between said high-voltage plate and insulating board is ≦0.5 m/m or said high-voltage plate is placed flush against the insulating board.

* * * * *